United States Patent [19]

Baumert et al.

[11] Patent Number: 4,511,460

[45] Date of Patent: Apr. 16, 1985

[54] MINIMIZING CORROSION IN COAL LIQUID DISTILLATION

[75] Inventors: Kenneth L. Baumert, Emmaus, Pa.; Alberto A. Sagues, Lexington; Burtron H. Davis, Georgetown, both of Ky.

[73] Assignee: International Coal Refining Company, Allentown, Pa.

[21] Appl. No.: 591,668

[22] Filed: Mar. 21, 1984

[51] Int. Cl.[3] ..... C10G 1/00; C10G 7/10; C23F 11/18

[52] U.S. Cl. ..... 208/348; 208/347; 208/308; 208/8 LE; 208/10; 208/47

[58] Field of Search ..... 208/8 LE, 47, 348, 354, 208/10, 308, 347

[56] References Cited

U.S. PATENT DOCUMENTS

| | | | |
|---|---|---|---|
| 3,272,736 | 9/1966 | Petro et al. | 208/47 |
| 3,458,453 | 7/1969 | Kautsky | 208/47 |
| 3,779,905 | 12/1975 | Stedman | 208/348 |
| 3,886,062 | 5/1975 | Peiser et al. | 208/354 |
| 4,062,764 | 12/1977 | White et al. | 208/348 |
| 4,229,284 | 10/1980 | White et al. | 208/348 |
| 4,314,898 | 2/1982 | Nakako et al. | 208/8 LE |
| 4,322,284 | 3/1982 | Tsai et al. | 208/8 LE |
| 4,404,084 | 9/1983 | Huibers et al. | 208/10 |
| 4,415,443 | 11/1983 | Murphy | 208/354 |

FOREIGN PATENT DOCUMENTS

| | | | |
|---|---|---|---|
| 0431519 | 7/1935 | United Kingdom | 208/47 |

*Primary Examiner*—Delbert E. Gantz
*Assistant Examiner*—Lance Johnson
*Attorney, Agent, or Firm*—Kimbley L. Muller

[57] ABSTRACT

In an atmospheric distillation tower of a coal liquefaction process, tower materials corrosion is reduced or eliminated by introduction of boiling point differentiated streams to boiling point differentiated tower regions.

6 Claims, 3 Drawing Figures

MINIMIZING CORROSION IN COAL LIQUID DISTILLATION

The Government of the United States of America has rights in this invention pursuant to Contract No. DE-AC05780R03054 (as modified) awarded by the U.S. Department of Energy.

BACKGROUND OF THE INVENTION

A necessary step in the production of solvent refined coal (SRC) and other coal liquefaction products is a solvent fractionation or distillation step. Such fractionation is usually accomplished in a distillation tower at atmospheric or below atmospheric pressures. It has been found that the synergistic reaction which contributes to corrosion in the tower involves chloride containing species in combination with low boiling weakly basic nitrogen containing streams. These lower boiling nitrogen containing streams distill upwardly in the tower until they reach a level where they remain in solution due to a combination of boiling point and solubility factors. Chloride containing fractions flow down the column. The low boiling nitrogen compounds, by forming the amine hydrochloride, provide a means of holding the chloride in the tower thus allowing corrosion due to prolonged contact with the acidic hydrochloride species. The location of this amine hydrochloride formation depends upon the boiling point, solubility, and base strength of the amines on the particular tray within the tower. In general, though, the higher boiling heavier nitrogen compounds are more strongly basic and so tend not to form amine hydrochlorides. It is the presence of such amine hydrochlorides which contributes greatly to corrosion of tower materials. It has been found that the chemical makeup of the coal liquids within the fractionation tower are highly corrosive. Corrosion rates on the order of 1,000 mpy (mils per year) have been reported for stainless steel tower materials. The severity of this corrosion has required the relining, retraying, or total replacement of fractionation apparatus.

PRIOR ART

In an effort to reduce or eliminate corrosion in coal liquid fractionation towers, several methods have been tested and/or used. These techniques are usually directed to neutralizing the coal liquid streams. Towers used in coal tar distillation have been maintained at low levels of corrosion by the injection of sodium carbonate into the tower as a solution. However, the solvent flashes and resulting sodium carbonate solid drops out near the injection point. As a result, the tower has a tendency to plug near the injection point and must be taken out of service for frequent cleaning.

Injection of sodium hydroxide to the tower has also been used. Because sodium hydroxide is a stronger base, the quantities required to prevent corrosion are lower. However, polymerization of hydrocarbons in the tower is promoted by the strength of the base and can cause plugging problems.

Sodium carbonate addition of feed coal has proven to be effective at reducing corrosion of the fractionation apparatus. However, approximately 1.5 times stoichiometric amounts are needed because of competing reactions with aluminum, silicon, and sulfur. In addition, most of the sodium ends up in the ash and is thus detrimental to the gasifier. Finally, this amount of sodium carbonate addition to the process is extremely costly.

Other techniques such as water washing the imcoming stream and side stream draw off have been considered and tested in the laboratory. These techniques are either impractical due to energy considerations or present problems in dealing with the waste they create.

OBJECTIVES OF THE INVENTION

It is a primary object of the present invention to substantially reduce or eliminate corrosion in the coal liquid fractionation tower of a coal liquefaction facility.

It is yet another object of the present invention to reduce or eliminate coal liquid fractionation tower corrosion while maintaining both energy efficiency and economy.

It is a further object of this invention to eliminate coal liquid fractionation tower corrosion while not contributing to tower plugging.

BACKGROUND OF THE INVENTION

It has been determined that the corrosive constituents in coal liquids are phenols, nitrogen compounds, and certain water soluble chlorides. These three constituents interact synergistically to corrode iron based alloys in a reaction with an approximate ultimate stoichiometry of:

$$Fe+2HCl=FeCl_2+H_2 \quad (1)$$

Thus, the formation of acidic hydrochloride is the primary contributor to corrosion of tower construction materials. Prior attempts to neutralize these hydrochlorides have been unsuccessful or less effective than is desirable due to side effects such as tower plugging.

BRIEF DESCRIPTION OF THE INVENTION

The present invention reduces formation of the acidic amine hydrochlorides primarily responsible for corrosion in coal liquefaction system fractionation systems by reducing the degree of contact between acidic low boiling nitrogen-containing compounds and coal-derived chlorides within the fractionation tower.

This is accomplished by introducing the lower boiling nitrogen-containing compounds into the upper reaches of the tower where they distill and exit immediately.

DETAILED DESCRIPTION OF THE INVENTION

The present invention does away with the lower feed tank known in the prior art and introduces to the tower, three nitrogen containing streams from the coal liquefaction process, differentiated by boiling point. The lowest boiling nitrogen compounds (boiling below 400° F.) are introduced to the top of the distillation tower. Medium boiling nitrogen compounds (boiling at 400°-550° F.) are introduced into the middle of the tower. In a similar manner, the higest boiling nitrogen compounds (boiling above 550° F.) are introduced at the bottom of the tower. It has been found that the chloride containing species tend to accumulate generally in the 400° to 450° F. range of the tower. In conventional systems, the migration of the low boiling nitrogen compounds from the feed point to the top of the tower allows intimate contact and reaction to form amine hydrochlorides. By introducing these low boiling nitrogen compounds to the top of the atmospheric or below atmospheric distillation tower, such compounds distill out of the tower and are not allowed to contact chloride containing streams for any significant length of time. Further, the higher basic strength of medium and high boiling nitrogen compounds prevents the formation of the amine hydrochloride compounds which have been found to contribute significantly to tower material corrosion.

Figure 1:
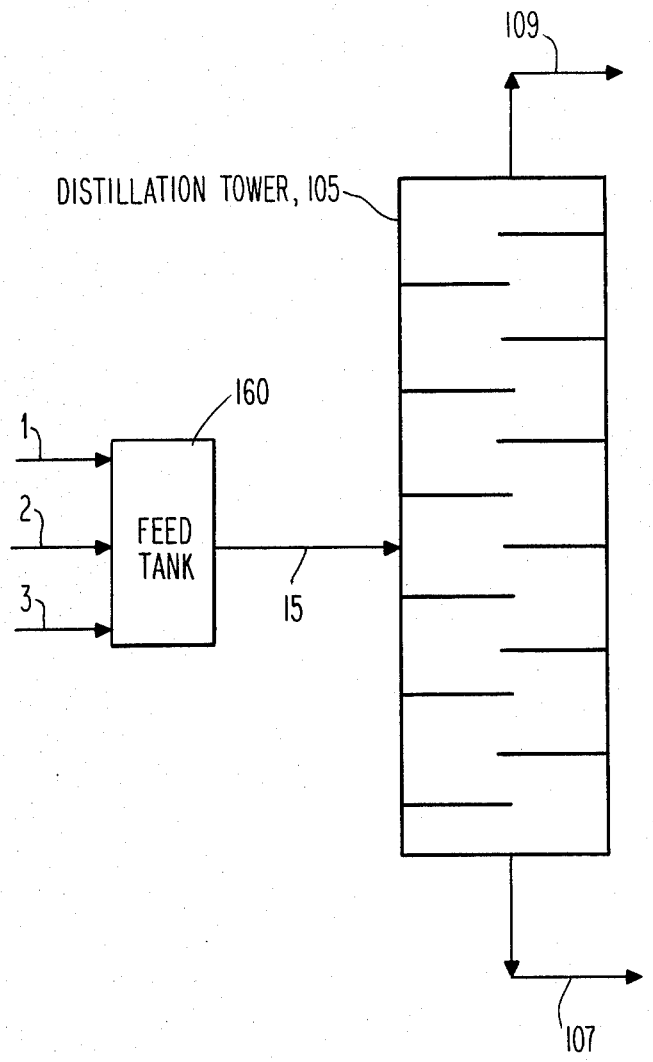
PRIOR ART Fig. 1
FIG. 1 is a block diagram of the fractionation tower feed flow of the prior art.

Referring now to FIG. 1, which describes a system typical of the prior art, all coal liquid streams (containing nitrogenous compounds) represented by inlet lines 1, 2 and 3 are mixed together in tower feed tank 160 and subsequently fed via line 15 to atmospheric tower 105.

Figure 2:
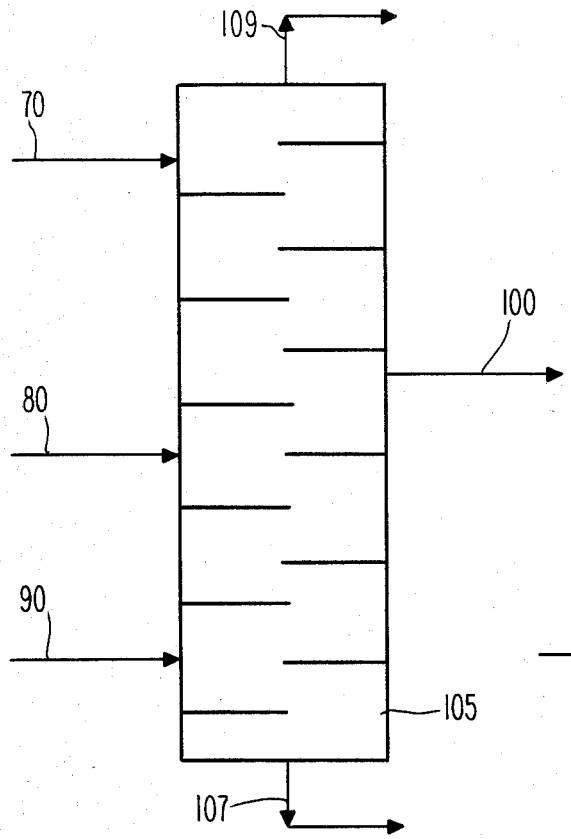
FIG. 2 is a block diagram of the preferred embodiment of the fractionation tower feed flow of the present invention.

The present invention, detailed in FIG. 2, includes low-boiling nitrogen-compound-containing stream feed line 70, medium-boiling nitrogen-compound-containing stream feed line 80 and high-boiling nitrogen-compound-containing stream feed line 90 fed respectively to the top, midsection, and bottom of atmospheric tower 105. An additional withdrawal line from tower 105 is provided as line 100 for the withdrawal of the amine hydrochloride compounds which tend to form in the 400°–450° F. range tray of tower 105.

A typical coal liquid stream, 8.1 wt. % boils below 450° F., 40.9 wt. % boils at 450°–550° F., and 51 wt. % boils above 550° F.

The stream comprising materials which boil below 450° F. contains many species of basic nitrogenous compounds including substituted anilines and pyridines. The remainer of the low boiling stream is comprised of neutral aromatics and saturated hydrocarbons (including 2-methylnaphthalene, 2- and 5- methyltetralin, naphthalene, and tetralin), and $C_1$–$C_4$ alkyl substituted 1-ring phenols.

The 450–550° F. stream basic nitrogenous materials comprise principally pyridines and quinolines ($C_1$–$C_2$ alkyl isomers). Other non-nitrogenous components include $C_1$–$C_5$ alkyl substituted phenols and indanols, $C_1$- and $C_2$- tetralins and acenaphthalenes.

It is principally the nitrogenous compounds boiling below 450° F. that contribute to corrosion within the tower. The present invention, by introducing these compounds into the tower at a point above the region containing high chloride concentrations, tends to prevent or reduce the reactions which contribute to tower corrosion.

Alternatively, or in combination with the above described feed techniques, the high boiling nitrogen compounds and chloride fraction may be reacted with low boiling nitrogen compounds to form amine hydrochlorides before entry into tower 105.

Figure 3:
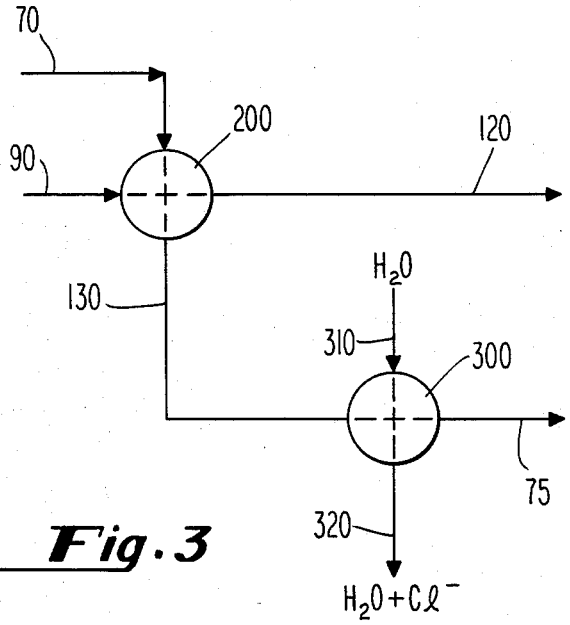
FIG. 3 is a block diagram of an alternative embodiment of the fractionation tower feed flow of the present invention.

Referring now to FIG. 3, stream 70 is mixed with stream 90 in vessel 200 to form streams 120 and 130. Stream 120 constitutes high boiling nitrogen compounds essentially free of chlorides. Stream 130 comprises low boiling nitrogen compounds and amine hydrochlorides which can then be water washed to remove such chloride fractions. The resulting low boiling nitrogen compound stream can be directed to tower 105 in accordance with the diagram flow of FIG. 2.

We claim:

1. A coal liquefaction fractionation process including a distillation tower to reduce the presence of amine hydrochlorides therein, wherein said distillation tower separates coal liquids containing nitrogen compounds and has:

(i) a bottom region wherein the temperature is greater than 450° F.;

(ii) a middle region wherein the temperature is from 400–450° F.; and (iii) a top region wherein the temperature is below 400° F.; wherein in said process (a) high boiling nitrogen-compound-containing streams having a boiling point of greater than 550° F. and containing amine hydrochloride precursors are introduced into said bottom region of said distillation tower;

(b) medium boiling nitrogen-compound-containing streams having a boiling point of 400°–450° F. are introduced into said middle region of said distillation tower; and (c) low boiling nitrogen-compound-containing streams having a boiling point of less than 400° F. are introduced into said upper region of said distillation tower; and wherein said streams of (a), (b) and (c) are nitrogen-compound-containing streams that are not admixed before charge to said distillation tower.

2. The process of claim 1 wherein the nitrogen compound contained in said low-boiling nitrogen-compound-containing stream is a member selected from the group consisting of anilines and pyridines.

3. The process of claim 1 wherein the nitrogen compound contained in said medium-boiling nitrogen-compound-containing stream is a member selected from the group consisting of pyridines and quinolines.

4. The process of claim 1 wherein chloride containing materials collected in the middle region of said tower are periodically removed from said tower.

5. A coal liquefaction fractionation process including a distillation tower to reduce the presence of amine hydrochlorides therein, wherein said distillation tower separates coal liquids containing nitrogen compounds and has:

(i) a bottom region wherein the temperature is greater than 550° F.;

(ii) a middle region wherein the temperature is from 400°–550° F.; and (iii) a top region wherein the temperature is below 400° F.; wherein in said process (a) a nitrogen compound containing stream having a boiling point of greater than 550° F. and containing amine hydrochloride precursors is admixed with a second nitrogen compound-containing stream having a boiling point range of less than 450° F. to convert said amine hydrochloride precursors to amine hydrochloride and to form a low boiling stream containing amine hydrochlorides and a high boiling stream essentially free of amine hydrochlorides;

(b) water-washing said low boiling stream containing said amine hydrochlorides to remove said amine hydrochlorides to produce a low boiling stream substantially free of amine hydrochlorides; and (c) distilling said high and low boiling streams both free of amine hydrochlorides in said fractionation system.

6. The process of claim 5 wherein the nitrogen compounds contained in said low-boiling nitrogen-compound-containing stream is a member selected from the group consisting of anilines and pyridines.

* * * * *